US010821452B2

(12) United States Patent
Trabelsi et al.

(10) Patent No.: US 10,821,452 B2
(45) Date of Patent: Nov. 3, 2020

(54) APPARATUS FOR THE INTERMITTENT APPLICATION OF A LIQUID TO PASTY MEDIUM ONTO AN APPLICATION SURFACE

(75) Inventors: Markus Trabelsi, Sprockhoevel (DE); Michael Surenbrock, Krefeld (DE); Andreas Pahl, Erkrath (DE)

(73) Assignee: Illinois Tool Works Inc., Glenview, IL (US)

( * ) Notice: Subject to any disclaimer, the term of this patent is extended or adjusted under 35 U.S.C. 154(b) by 1346 days.

(21) Appl. No.: 14/352,332

(22) PCT Filed: Dec. 16, 2011

(86) PCT No.: PCT/US2011/065565

§ 371 (c)(1),
(2), (4) Date: Dec. 15, 2014

(87) PCT Pub. No.: WO2012/083207

PCT Pub. Date: Jun. 21, 2012

(65) Prior Publication Data

US 2015/0125616 A1 May 7, 2015

(30) Foreign Application Priority Data

Dec. 17, 2010 (DE) ..... 10 2010 055 019

(51) Int. Cl.
*B05B 1/30* (2006.01)
*B05C 5/00* (2006.01)
(Continued)

(52) U.S. Cl.
CPC ..... *B05B 1/30* (2013.01); *B05B 1/24* (2013.01); *B05B 1/32* (2013.01); *B05C 5/001* (2013.01);
(Continued)

(58) Field of Classification Search
CPC ..... B05B 1/30; B05B 1/32; B05C 5/0275; B05C 5/0279
See application file for complete search history.

(56) References Cited

U.S. PATENT DOCUMENTS 5,773,080 A * 6/1998 Simmons ..... B05C 5/0279 427/177
5,992,686 A 11/1999 Cline et al.
(Continued)

FOREIGN PATENT DOCUMENTS

CN 1092482 A 9/1994
CN 1289271 A 3/2001
(Continued)

OTHER PUBLICATIONS

ISR for PCT/US2011/065565 dated Sep. 6, 2012.
Office Action issued in European Application No. 11 805 353.7; dated Jul. 10, 2017; 4 pages.

*Primary Examiner* — Dah-Wei D. Yuan
*Assistant Examiner* — Stephen A Kitt
(74) *Attorney, Agent, or Firm* — Levenfeld Pearlstein, LLC

(57) ABSTRACT

An apparatus for the intermittent application of a liquid to pasty medium onto an application surface, comprising an application valve which can be switched between an open and a closed state and is intended for dispensing the medium onto the application surface, a volumetric delivery pump for metering a volume of the medium to be passed on to the application valve, and a drive for operating the volumetric delivery pump is, inter alia, described and illustrated. The characteristic feature consists in that the apparatus has an electronic controller which, in each case cyclically, activates the drive and the application valve in dependence on each other.

9 Claims, 5 Drawing Sheets

Figure 1:
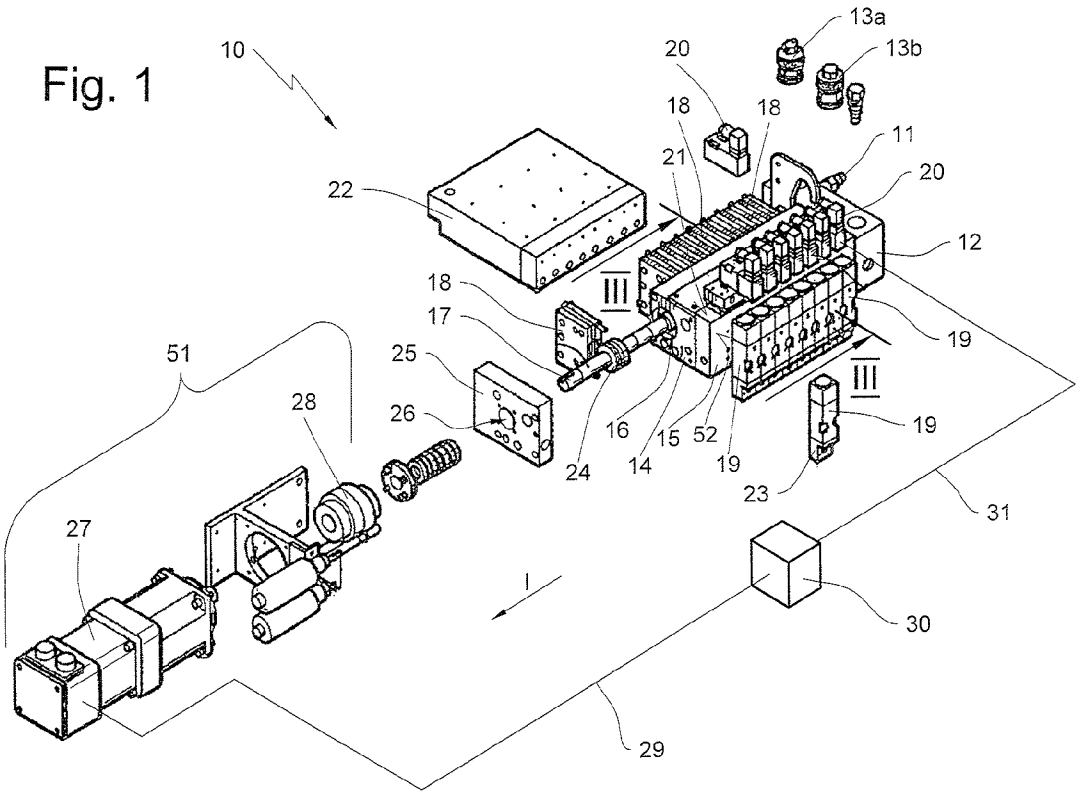

(51) Int. Cl.

| | |
|---|---|
| ***B05C 5/02*** | (2006.01) |
| ***B05B 1/32*** | (2006.01) |
| ***B05B 1/24*** | (2006.01) |
| ***B05D 1/02*** | (2006.01) |
| ***F04C 2/18*** | (2006.01) |
| ***F04C 13/00*** | (2006.01) |

(52) U.S. Cl.
CPC ..... *B05C 5/0275* (2013.01); *B05C 5/0279* (2013.01); *B05D 1/02* (2013.01); *F04C 2/18* (2013.01); *F04C 13/002* (2013.01); *F04C 2220/24* (2013.01); *F04C 2240/70* (2013.01)

(56) References Cited

U.S. PATENT DOCUMENTS

| | | | | |
|---|---|---|---|---|
| 6,161,723 | A | 12/2000 | Cline et al. | |
| 6,296,463 | B1 * | 10/2001 | Allen | B05B 7/0807 118/315 |
| 6,334,554 | B1 | 1/2002 | Bolyard, Jr. et al. | |
| 6,422,428 | B1 * | 7/2002 | Allen | B05B 7/0807 222/255 |
| 6,675,988 | B2 | 1/2004 | Cline et al. | |
| 6,688,498 | B1 | 2/2004 | McGuffey | |
| 6,913,166 | B2 | 7/2005 | Cline et al. | |
| 7,946,402 | B2 | 5/2011 | Gassmann et al. | |
| 2004/0072364 | A1 | 4/2004 | Tisone et al. | |
| 2005/0230423 | A1 | 10/2005 | Riney et al. | |
| 2006/0169205 | A1 * | 8/2006 | Liu | B05C 5/0258 118/683 |
| 2007/0122291 | A1 | 5/2007 | Okumura et al. | |
| 2007/0248763 | A1 | 10/2007 | Mendez-Gallon | |
| 2008/0277239 | A1 * | 11/2008 | Gassmann | F04C 2/103 192/85.01 |

FOREIGN PATENT DOCUMENTS

| | | | | |
|---|---|---|---|---|
| DE | 102005014654 | A1 | 10/2006 | |
| EP | 1147820 | A2 | 10/2001 | |
| EP | 1429029 | A2 | 6/2004 | |
| JP | 10462384 | U | 5/1992 | |
| JP | H08141466 | A | 6/1996 | |
| JP | 2640846 | B2 | 8/1997 | |
| JP | 3630177 | B2 | 3/2005 | |
| JP | 5129147 | B2 | 1/2013 | |
| WO | 99/43606 | A1 | 9/1999 | |
| WO | 99/54055 | A1 | 10/1999 | |
| WO | WO 9954055 | A1 * | 10/1999 | B05B 7/0807 |
| WO | 2006/069851 | A1 | 7/2006 | |

* cited by examiner

APPARATUS FOR THE INTERMITTENT APPLICATION OF A LIQUID TO PASTY MEDIUM ONTO AN APPLICATION SURFACE

RELATED APPLICATIONS

The present application is a National Phase of International Application Number PCT/US2011/065565 filed Dec. 16, 2011 and claims priority to German Application Number 102010055019.1 filed Dec. 17, 2010.

The invention relates first of all to an apparatus according to the preamble of claim 1.

Corresponding application apparatuses, which can be designed in particular for the application of a molten adhesive or of a heated, molten adhesive agent, onto a substrate, are basically known from the prior art, for example from EP 1 429 029 A2 belonging to the applicant.

In basically advantageous apparatuses of this type for the intermittent dispensing of an adhesive, in which the volume of the adhesive to be dispensed is metered via a volumetric delivery pump, there may be the need, under some circumstances, to deposit the medium even more homogeneously onto the surface to be commissioned.

Since apparatuses of this type permit intermittent application, for which purpose, in particular, an application valve can be cyclically switched between a closed and an open state, it is considered desirable for the medium applied onto the surface during a dispensing operation to have a homogeneous layer thickness. In the known prior art apparatuses, inhomogeneities may namely occur in this respect, since pressure is built up within the apparatus (in particular in a channel arranged between a volumetric delivery pump and the application valve) by accumulated medium. As a result, when the application valve is opened, the medium may initially be discharged at too high a pressure. At the end of the application operation, i.e. when the valve is still open, said pressure is customarily dissipated such that, although medium is still being discharged, the discharge is significantly less than directly after opening of the application valve.

This has the effect on the substrate being commissioned, which is customarily guided along by means of a delivery device at high speed under an outlet nozzle assigned to the application valve, that the layer thickness of a medium portion applied during a dispensing operation increases in the delivery direction. Although the respectively applied medium portions can have an approximately constant volume in comparison to one another, the distribution of medium within a portion (what is referred to as "in-line distribution") is considered worthy of improvement.

Proposals for solving this problem, which are known from prior art not verifiable in terms of documents, consist, inter alia, in opposing a build up of pressure within the delivery channel between the volumetric delivery pump and application valve. For this purpose, it is possible, for example, to provide a circulation device which provides a separate return channel between the application valve and volumetric delivery pump or between the application valve and a reservoir of the medium. This return channel has the effect that, when the application valve is closed, the medium volume delivered by the volumetric delivery pump is not accumulated but rather can drain away via the separate return channel to the reservoir of the medium or to the delivery pump.

Although a solution of this type may, under some circumstances, slightly oppose the inhomogeneities within a discharged medium portion, said solution can in practice only be used with difficulty, since the channel between the volumetric delivery pump and application valve forms an "open system" which is too complicated and not sufficiently precise, since manual adaptations of the pressure have to be undertaken for the circulation device in order to achieve exact adaptations to the volumetric type of delivery pump.

An alternative solution which is basically readily suitable for achieving homogeneous application portions consists in arranging a heated hose, which serves as an accumulator, between the volumetric delivery pump and the application valve. Hoses of this type may be formed, for example, from plastic, wherein said plastics hoses are surrounded by separate steel mesh hoses which can prevent the plastics hose from bursting. In addition, a heating wire may be incorporated into the hose arrangement.

Said hose arrangements firstly permit transport of the medium from a volumetric delivery pump to an outlet nozzle arranged at a very great distance or to a remote application valve and, secondly, permit prevention of an excessive build up of pressure of the medium in the hose owing to basic elasticity of the hose. The elasticity of the hose makes additional expansion space available to the medium, as a result of which, when the application valve is open, there is customarily no excess pressure of the medium at the application valve, and therefore the medium can be discharged relatively homogeneously.

However, inertia of the hose arrangement, which is advantageous with respect to the homogeneity of the discharging medium, has a critical disadvantage which can be seen in the fact that, during a re-start, a corresponding apparatus cannot be used for a certain starting time (an apparatus of the type in question needs, for example, up to 30 seconds in order to adjust all of the components upward to a desired operating capacity).

For example, during the starting up of the apparatus, a delivery device for the material being commissioned is accelerated approximately uniformly, wherein, customarily, the delivery capacity of the volumetric delivery pump is also adjusted at the same time. However, the inertia of the hose prevents the continuous change in the delivery rate providing a desired application pattern during the booting up of the system (what is referred to as a ramp effect). Customarily, therefore, when the described hose system is used, the products commissioned during the starting up of the apparatus cannot be used and have to be disposed of, which signifies a considerable disadvantage in terms of production.

Proceeding from the described prior art, it is the object of the present invention to provide an apparatus which permits a homogeneous, intermittent application during all of the production phases.

The invention achieves this object with the features of claim 1, in particular with those of the characterizing part, and is accordingly characterized in that the apparatus has an electronic controller which, in each case cyclically, activates or switches the drive of the volumetric delivery pump and the application valve in dependence on each other.

Accordingly, the concept of the invention can be considered that of adapting the volume of the medium to be applied, the volume being measured or metered by the volumetric delivery pump, to the switching state of the application valve, in particular depending on whether medium delivered at a predetermined time to the application valve is required (namely when the valve is open) or is not (mainly when the valve is closed).

This makes it possible in a natural manner to prevent pressure being built up in the channel between the volumetric delivery pump and application valve, and therefore the medium emerging at the beginning of an application operation (i.e. when the application valve is open) is not under an undesirably high pressure.

In this regard, it should be noted, merely for the sake of completeness, that the medium, at any rate if the liquid to pasty medium is a molten adhesive, as a first approximation is customarily not compressible at all. In practice, however, corresponding fluids contain air pockets, and therefore the delivered medium as a whole nevertheless has a certain degree of compressibility.

According to the invention, an accumulator (in particular an expandable hose) is not required, and therefore the apparatus claimed in the present case also does not have the disadvantages of an inert hose system. It is thus namely possible for the controller to adapt the capacity of the delivery pump, even during starting up, i.e. starting, of the apparatus, to the desired application rate (in particular also with regard to the acceleration to be undertaken of the substrate being commissioned) in such a manner that homogeneous application is possible, and the products commissioned during the starting-up process do not have to be disposed of but rather can be used.

In addition, a delivery channel of the apparatus between the volumetric delivery pump and application valve can be designed to be closed (and in particular sealed) as a whole, since, namely, a circulation device with return channels is not required. By omission of return channels, the operating convenience of the claimed apparatus can be increased as a whole, since manual adjustments of the circulation device are unnecessary and since more exact discharges are possible owing to the system being better sealed.

Customarily, the electronic controller can cyclically or periodically adjust the drive of the volumetric delivery pump depending on the signal for controlling the application valve. In this case, the volumetric delivery pump can be, for example, stopped or paused when the application valve is or has been closed. Secondly, when the application valve is or has been opened, the volumetric delivery pump can be driven (for measuring out, metering and for providing the volume of the medium to be dispensed).

By contrast, it is merely known from the described prior art to drive the delivery pump continuously (in particular at a continuous speed, continuous delivery capacity and/or continuously metered medium rate). It is furthermore known to slowly adjust the delivery pump upward during the starting of the apparatus, in adaptation to the acceleration of the substrate being commissioned. Even if the controller in this case starts the motor and the application valve approximately at the same time, this does not constitute an activation of the drive and application valve taking place cyclically and in dependence on each other. In contrast thereto, the concept of the present invention can be considered that of varying the delivery capacity of the volumetric delivery pump, namely with regard to the outlet rate actually required at the application valve.

Whereas, in the case of an apparatus of the prior art, the volumetric delivery pump is driven continuously (and with a continuous and identical delivery volume), in the case of the apparatus according to the invention the volumetric delivery pump can be, for example, completely paused for a predetermined time interval and can subsequently be driven with a correspondingly increased delivery capacity for a further time interval. Of course, the delivery capacity of the volumetric delivery pump is customarily set higher in the driving time interval than in the case of an apparatus of the prior art, in which delivery is continuous, at a lower delivery capacity.

The volumetric delivery pump here can be adjusted, for example, to and fro between a preset delivery value and a zero value, namely in dependence on the switching state of the application valve. As an alternative, however, it can basically also be planned for the volumetric delivery pump to be adjusted between a predetermined maximum value and a predetermined minimum value (which differs from the zero value). In other words, it is not absolutely necessary for the volumetric delivery pump to be completely turned off. It can optionally even be planned for the volumetric delivery pump to be adjusted downward below the zero value such that the delivery pump produces a negative delivery capacity.

However, it is crucial for the control program of the volumetric delivery pump and for the control program of the switching state of the application valve to be coordinated with each other by the electronic controller. Fine adjustments and calibrations can be undertaken in this case by the controller (or manually with the aid of the controller) in such a manner that, first of all, the inertia of the drive of the volumetric delivery pump and the inertia of the switching operation of the application valve are determined and are taken into consideration in the activation of the application valve and volumetric delivery pump.

The application valve can thus be customarily switched to and fro between an open and a closed state more rapidly than the volumetric delivery pump can be switched between the desired nominal capacity thereof and a zero value. Accordingly, activation by means of the controller can take place in such a manner that the controller first of all signals to the drive of the volumetric delivery pump to switch off the delivery pump and that the controller signals slightly later to the application valve to switch over into the closed state thereof. In other words, the electronic controller can take the inertia of the driving system for the delivery pump and the inertia of the switching system of the application valve into consideration during the activation.

With the apparatus according to the invention, the applicant succeeded in countering the problem of inhomogeneous discharge not, as in the prior art, by reducing the effects of a build up of pressure of the medium. On the contrary, the applicant has recognized that, by varying the driving power of the volumetric delivery pump, a build up of pressure can be prevented at the beginning, and therefore the problems known from the prior art are avoided and a homogeneous application pattern is achieved.

Accordingly, the apparatus according to the invention succeeds in improving the application of a medium onto an application surface which is configured in particular in the form of a two-dimensional moving body. However, for example, surfaces which are not two-dimensional of threads or the like to be commissioned may also be considered to be application surfaces within the context of the present invention.

At any rate, the application surface is advantageously moved relative to the outlet nozzle and is moved at, preferably a higher, speed past an outlet nozzle assigned to the application valve. As an alternative, however, configurations are, of course, also conceivable, in which the outlet nozzle is moved relative to a positionally fixed surface.

According to the invention, the application valve can be switched between an open and a closed state in such a manner that the medium to be applied can be dispensed in the open state of the application valve and not in the closed state. For this purpose, the application valve is customarily assigned a nozzle needle or valve needle or a corresponding head. The needle can block or close access of the delivered medium to an outlet opening in the closed state of the application valve. In order to transfer the application valve into the open state thereof, said needle can furthermore be moved into a release position, in which the liquid to pasty medium can pass to the outlet opening.

It is advantageously possible for what is referred to as a "recirculating valve" to be used, as is known, for example, from EP 1 147 820 B1 belonging to the applicant, the contents of which are hereby completely incorporated into the disclosure of the present application.

In order to apply the medium from an outlet nozzle, which is assigned to the application valve, on to the application surface, the outlet nozzle can advantageously be designed as a spraying nozzle. The latter is assigned a spraying air entrance in such a manner that (in particular heated) spraying air can be used as the medium carrier for the spraying application onto the application surface. As an alternative, however, any other type of nozzle, for example a slotted nozzle (without supply of spraying air) can be used.

The application valve can be switched, in particular pneumatically, between the open and the closed state thereof. Of course, however, the range of protection is not restricted to valves of this type. For example, the valve could also be adjustable electromagnetically. A 24V directional control valve is advantageously provided for the pneumatic supply of compressed air to the application valve.

Within the context of the present patent application, the volumetric delivery pump is to be understood in particular as a high precision pump which is suitable for highly precisely measuring out and passing on a desired volume of the medium. If the delivery pump in this case is designed as a gear pump, the delivery rate of the medium customarily behaves proportionally to the number of revolutions of the gearwheels, with it thereby being possible to very exactly meter the delivery rate.

When the delivery pump is designed as a gear pump, the drive is in particular assigned a shaft with a shaft gearwheel which is arranged thereon and can interact with a driving gearwheel of the delivery pump in order to drive the delivery pump.

The drive customarily comprises a driving motor and optionally a coupling arranged between the motor and the drive shaft.

The electronic controller according to the present invention can be designed, for example, as a computer unit, in particular as a memory-programmable controller, special controller or conventional personal computer which is also assigned a monitor and an input unit, for example a keyboard, for the manual operation or modification of the electronic controller. The controller in this case can activate both the drive, in particular a driving motor, and the outlet nozzle and can be connected to said drive and outlet nozzle in particular via cables or else via a cable-free network or a similar bodiless connection. In every case, both the drive and the application valve (or a switching unit assigned thereto) have to be designed in such a manner that they can, at least indirectly, receive control orders from the electronic controller. In this context, the controller may, for example, also transmit control orders to a compressed air unit assigned to the application valve and may control said compressed air unit in such a manner that the application valve has a switching behavior as per requirements.

According to an advantageous configuration of the invention, the apparatus is designed as an apparatus for the application of a molten adhesive or a molten adhesive agent. In such an application, the present invention can be used particularly advantageously since, in the case of fluid or media of this type, particularly rapid discharge from the apparatus is desirable. In this case, the molten adhesive or the molten adhesive agent is customarily melted in a hot melt unit (which can be assigned to the apparatus, in particular can be included in the latter) such that the apparatus as a whole provides a reservoir of molten medium. In particular, the apparatus may also have just one fluid connection for a medium which is already molten.

So that the molten medium does not harden within the apparatus, the apparatus advantageously has heating means which receive the conducted adhesive or the conducted adhesive agent in a fluid, non-hardened state such that adhesions due to hardened medium do not occur within the apparatus. In particular, a heating unit can be assigned here to the conducting channel between the volumetric delivery pump and application valve.

After the molten adhesive or the adhesive agent has emerged and impinged on the application surface, the medium can and should subsequently harden.

According to a further advantageous configuration of the invention, the drive has a motor which is designed as a servomotor. The applicant has surprisingly established here, in numerous extensive tests, that it is possible, with one servomotor, to drive and to stop the volumetric delivery pump sufficiently rapidly in order to be set in relation to the switching behavior of the application valve. Consequently, the servomotor can drive and stop the volumetric delivery pump in an alternating manner such that said two states can be correlated in time with the open and closed states of the application valve. By this means, the applicant overcomes in particular a prejudice current in the world of experts, according to which there is an unwritten rule that a delivery pump has to be driven continuously during an intermittent application of a liquid to pasty medium. In other words, the use of a servomotor makes it possible to control the reaction times of the delivery pump in such a manner that the switching state of the delivery pump, in particular between a nominal value and a zero value, can be coordinated with the switching state of the application valve. As an alternative, a stepping motor may be used.

It is advantageously possible, as an alternative (in particular in applications having a further increase of application speed, and therefore in particular in applications having a further increase in the revolution speed of a delivery pump designed as a gear pump), to use an eddy current coupling. The latter is customarily arranged between a motor and the volumetric delivery pump, in particular between the motor and a drive shaft. The use of an eddy current coupling of this type can also ensure an activation according to the invention of the volumetric delivery pump and in particular an alternating pausing and driving of the delivery pump. It is basically also possible to use other rotationally flexible or switchable couplings for obtaining the desired effect, or even a solenoid coupling.

A main delivery pump is advantageously connected upstream of the volumetric delivery pump. A stream of the medium, for example a stream of the molten adhesive, can thereby be conducted from a reservoir to the volumetric delivery pump without the volumetric delivery pump needing to ensure a corresponding suction action. In contrast to the main delivery pump, the volumetric delivery pump permits precise measuring out and metering of a desired volume of the medium. A main delivery pump customarily does not have such metering properties but rather serves merely for basic passing-on purposes and is connected upstream of the volumetric delivery pump with respect to the direction of flow and is arranged in particular between the medium reservoir and delivery pump.

Furthermore advantageously, the volumetric delivery pump is designed as a gear pump. A gear pump of this type here has gearwheels which intermesh in order to meter the medium. It is possible to provide, for example, two or three separate, intermeshing gearwheels which are connected, in particular, in series. Said gearwheels may be arranged in a pump housing, wherein each gear pump customarily has a dedicated spindle fixed in the lateral boundary walls of the pump housing. Gear pumps of this type are customarily produced highly precisely in such a manner that the volumes delivered by the gear pumps are very precisely known. In particular, a gear pump of this type can have a driving gearwheel which can interact in an intermeshing manner with a shaft wheel of a drive shaft via an inlet slot of the pump housing. The medium to be delivered can also enter the pump housing through said slot. However, in principle, as an alternative to a gear pump any other suitable volumetric delivery pump, for example a gerotor pump, can be used.

According to a further advantageous configuration of the invention, the apparatus according to the invention has a conveying device for guiding along an application surface on an outlet nozzle assigned to the application valve. The application surface, for example a two-dimensional body, can thereby be guided along on or under the outlet nozzle. The application surface here is advantageously provided by a two-dimensional substrate which may be, for example, a non-woven. One use by way of example in this case could be, for example, the depositing of a hot melt adhesive on to a basic diaper material, from which a baby diaper can be worked subsequently. Accordingly, the substrate is in particular a moving web-shaped substrate, and therefore the substrate can be moved along an in particular linear path (for example with the aid of a conveyor belt) and can be commissioned with the medium.

Furthermore, provision can advantageously be made for a channel of rigid design and intended for passing on the metered medium to be applied to be arranged between the volumetric delivery pump and the application valve. In contrast to a flexible line designed in particular as a hose, a rigid channel is not to be regarded as an accumulator within the context of the present patent application, since the walls of the channel are consequently, at any rate as a first approximation, not flexible. This configuration has the advantage that the apparatus can be used correctly even during starting of the apparatus and commissioning of the application surfaces is possible even during starting up of the apparatus. A rigid channel may be formed, for example, by parts of the volumetric delivery pump, parts of the application valve and/or an adapter block or the like arranged therebetween. In principle, however, the apparatus according to the invention may alternatively also be configured with a hose-like channel for passing on the medium between the delivery pump and the application valve.

According to a particularly advantageous refinement of the invention, the apparatus is designed as a modular system, with a multiplicity of application modules, each application module being connected to one volumetric delivery pump unit each. A particularly flexible configuration of the apparatus can thereby be realized, in which each application module in particular comprises an application valve, and each volumetric delivery pump unit in particular comprises precisely one volumetric delivery pump. A plurality of parallel application rows of medium being applied can thus be made possible next to one another, for example, on a web-shaped substrate by, for example, two or more nozzle modules being arranged closely next to one another.

This configuration furthermore has the advantage that the rest of the apparatus can continue to be operated in an error-free manner if an individual application module or a delivery pump unit is damaged. In this case, the correspondingly damaged application module or delivery pump module can be interchanged in a simple manner and replaced by new modules.

The application modules and the delivery pump units are advantageously arranged linearly, i.e. in a row with each other, wherein the walls of the application modules can bear directly against one another. The same applies to the delivery pump units.

Furthermore advantageously, the volumetric delivery pump units can be drivable by a common drive shaft and a common drive. In this case, the drive shaft can have a dedicated connection for each delivery pump unit, for example in the form of a separate shaft gearwheel. In this case, a medium can be conducted along the drive shaft from a common medium reservoir to the delivery pump units.

However, the invention may equally also be used in an apparatus having just one application module or one application valve and one delivery pump module or one delivery pump unit.

A further aspect of the invention relates to a method for the intermittent application of a liquid to pasty medium on to an application surface. The methods known from the abovementioned prior art have the disadvantage that a uniform, intermittent application is not possible therewith.

It is accordingly a further object of the invention to improve the methods known from the prior art to the effect that a uniform application of a liquid to pasty medium is possible.

The invention achieves this object with the features of patent claim 8, wherein the method according to the invention in particular comprises the following steps:

a) providing a reservoir of the liquid to pasty medium,
b) driving a volumetric delivery pump for the metering of a volume of the medium,
c) passing on the metered volume of the medium to an application valve,
d) switching the application valve between an open and a closed state,
e) discharging the medium through the application valve onto the application surface.

According to the invention, provision is furthermore made to allow the driving of the volumetric delivery pump according to method step b) and the switching of the application valve according to method step d) to take place permanently (in particular over and beyond a multiplicity of application cycles or over and beyond the entire running time of the apparatus), in each case cyclically, in dependence on each other.

In particular, the method according to the invention according to patent claim 8 can be carried out with an apparatus according to the invention according to patent claim 1.

Accordingly, the method according to the invention and the apparatus according to the invention are closely linked to each other in such a manner that all of the advantages related to the independent apparatus claim and the dependent claims can expediently also be transferred to the method according to the invention, and, conversely, all of the advantages relating to the method according to the invention and dependent claims can also be transferred analogously to the apparatus according to the invention according to the independent apparatus claim.

All of the dependent claims provided in respect of the independent apparatus claim have also not been drafted separately for the independent method claim simply for clarity reasons. The same applies to the dependent method claims with respect to the independent apparatus claim.

In this case, both the apparatus according to the invention and the method according to the invention relate to an intermittent application of a medium with the effect of an interrupted or discontinuous and cycle-like application. In this case, the application valve is alternately cyclically opened and closed. An application or outlet cycle of this type comprises a complete opening operation of the application valve, the phase in which the valve is opened, a complete closing operation of the valve, and the phase in which the application valve is closed.

According to an advantageous refinement of the method according to the invention, the delivery capacity of the volumetric pump is throttled if the application valve is closed. Throttling of the delivery capacity and closing of the application valve do not have to take place precisely simultaneously here since (owing to the inertia of the driving mechanism of the delivery pump) the throttling of the delivery capacity to a desired minimum value customarily lasts longer than the closing of the application valve. However, provision is made for the throttling of the delivery capacity of the delivery pump and the closing of the application valve to take place substantially synchronously. Furthermore, provision can advantageously be made for the volumetric delivery pump here to be completely paused or for the drive driving the delivery pump or for the motor driving the delivery pump to be paused.

Conversely, it is advantageous if the delivery capacity of the volumetric delivery pump is increased if the application valve is opened. In this case, the increase of the delivery capacity and the opening of the application valve likewise take place substantially synchronously.

According to a particularly advantageous configuration of the invention, in order to operate the volumetric delivery pump, a drive is cyclically adjusted between a minimum value and a maximum value, the drive being adjusted toward the minimum value before the application valve is closed, and the drive being adjusted toward the maximum value before the application valve is opened.

This makes it possible in particular to take into consideration the relatively sluggish system of driving the volumetric delivery pump in comparison to the switching system of the application valve. The minimum value of the delivery pump may be, for example, a zero value.

Minimum and maximum values can relate in particular to the delivery capacity in the sense of the volume delivered or the driving speed of the delivery pump. If the delivery pump is designed, for example, as a gear pump, a value can relate to the revolutions of the delivery pump gearwheels or of a gearwheel per unit of time. A zero value is achieved if the gearwheels of the delivery pump come to a standstill or have paused.

Advantageously, the drive is adjusted toward the minimum value, in particular toward a zero value, before the application valve is closed, and the drive is adjusted toward the maximum value before the application valve is opened, in order for a cycle relating to the opening and closing of the application valve to behave substantially synchronously to the control cycle of the delivery pump. It is particularly advantageous if the time interval, in which the drive behaves as per a minimum value, is slightly shorter than the time interval, in which the application valve is closed. This also results in adaptation to the inertia of the delivery pump drive and in a substantial synchronization of an apparatus according to the invention.

The time interval, in which the drive behaves as per the minimum value thereof, in terms of the temporal arrangement thereof can lie completely in the time interval, in which the application valve is closed. On the other hand, provision may also be made for the time interval, in which the drive behaves as per the maximum value thereof, to be slightly shorter than the time interval, in which the application valve is open. This likewise permits adaptation to the inertia of the delivery pump drive.

Figure 2:
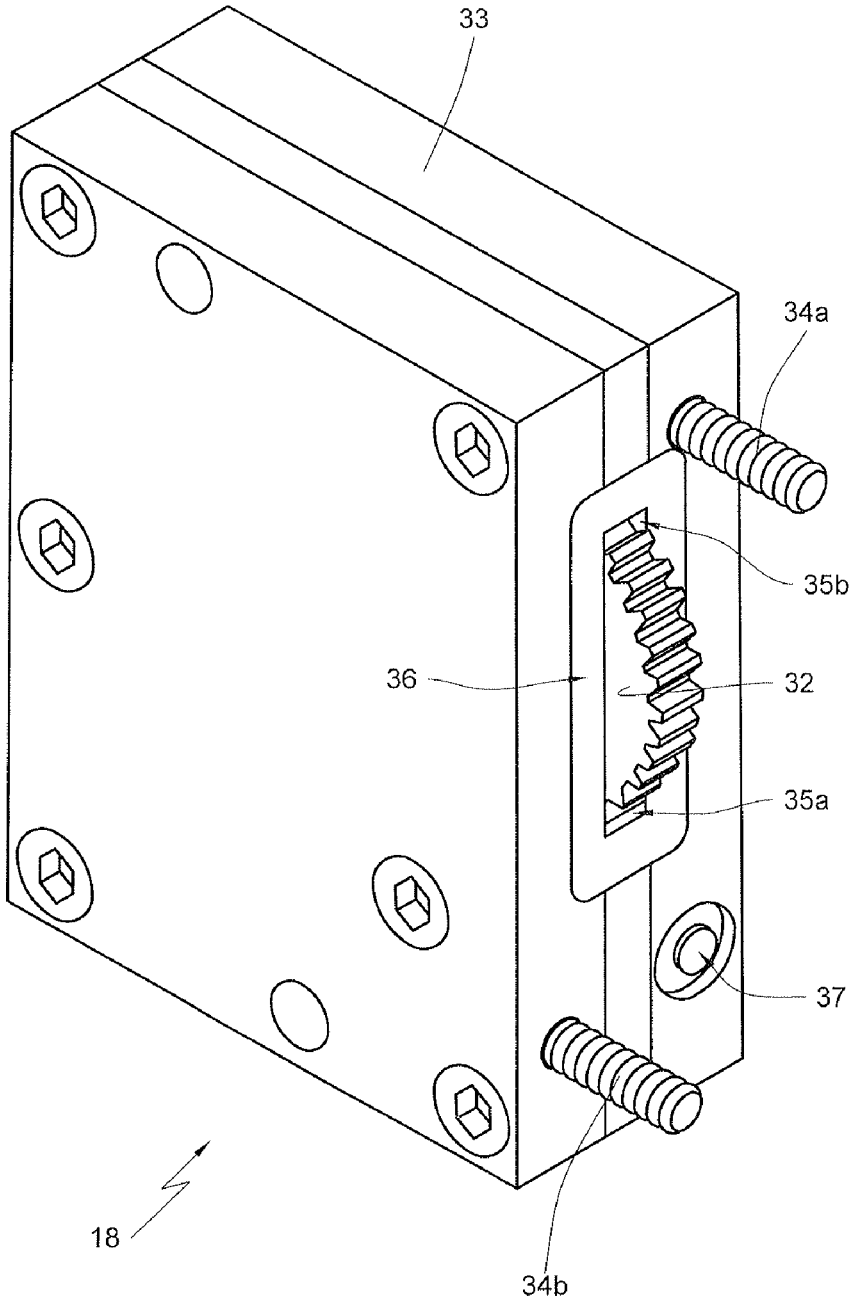
Figure 3A:
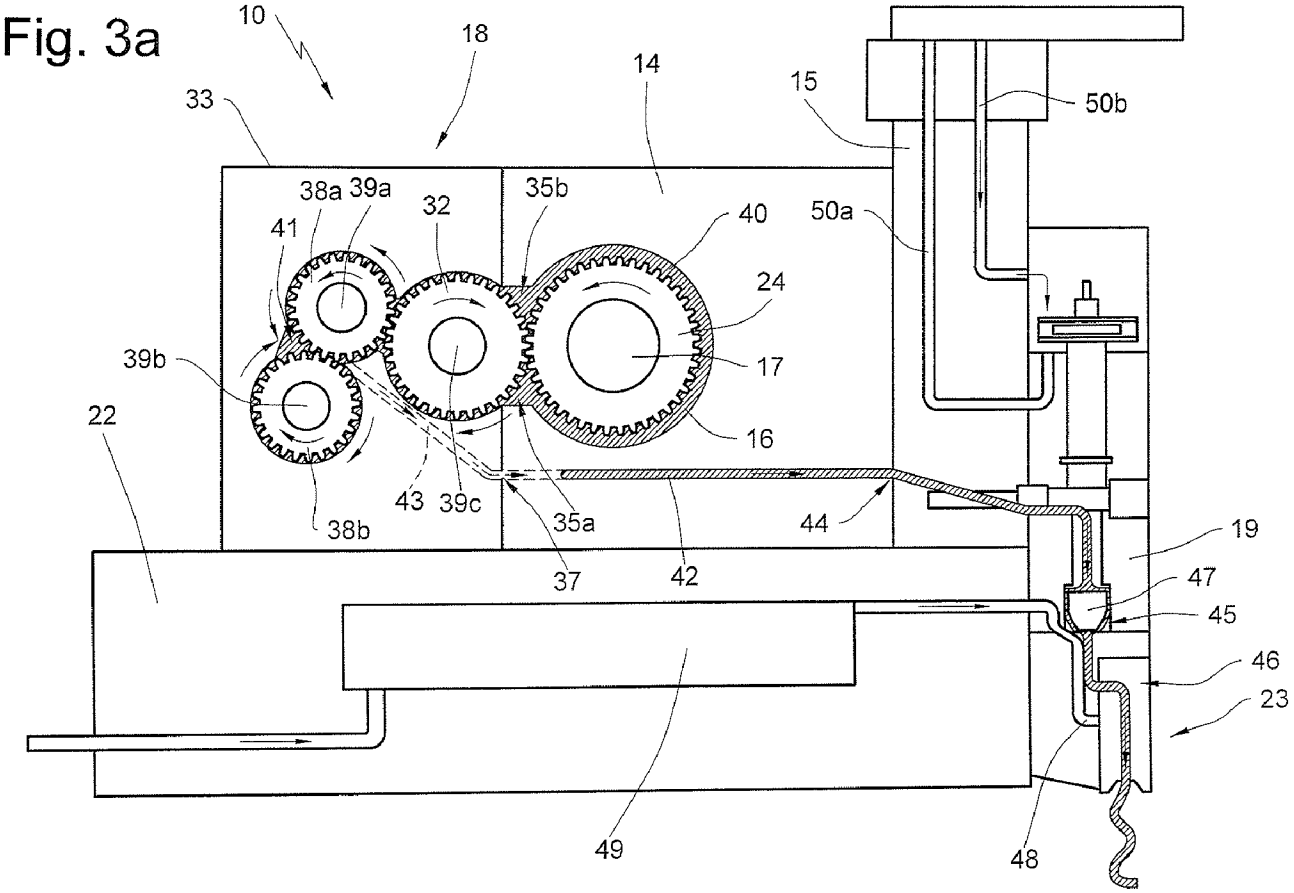
Figure 3B:
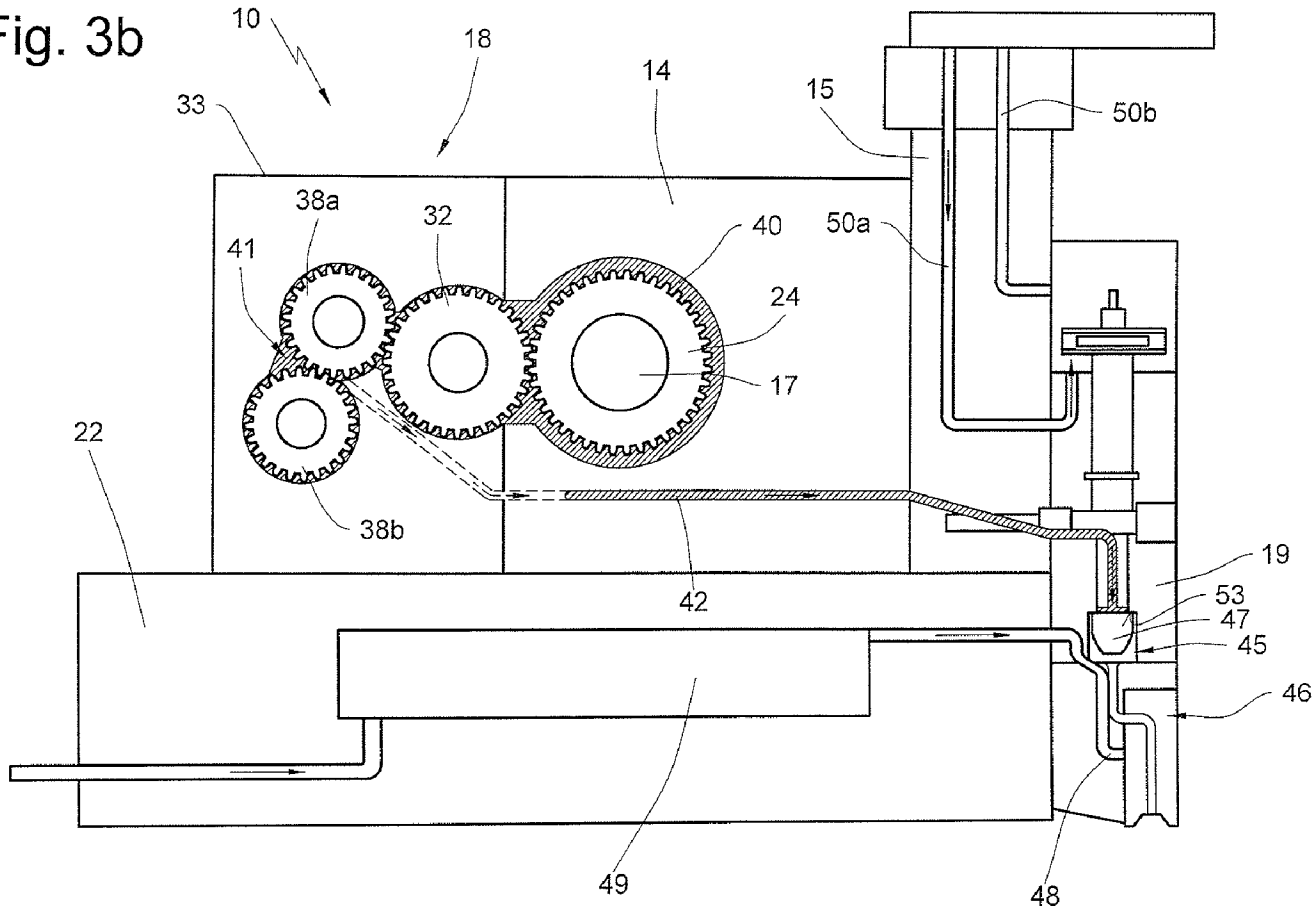
Figure 4:
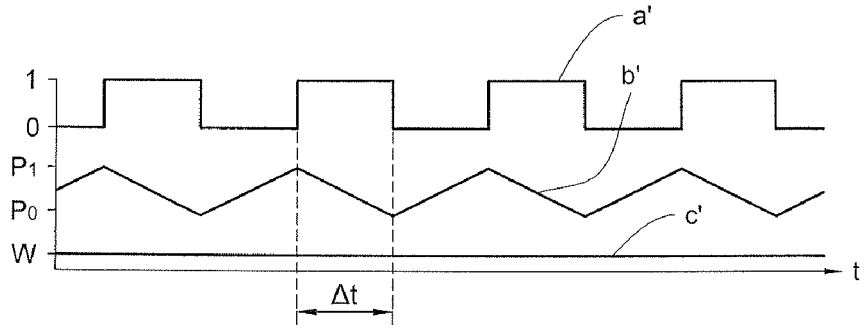
Fig. 4 Prior art
Figure 5:
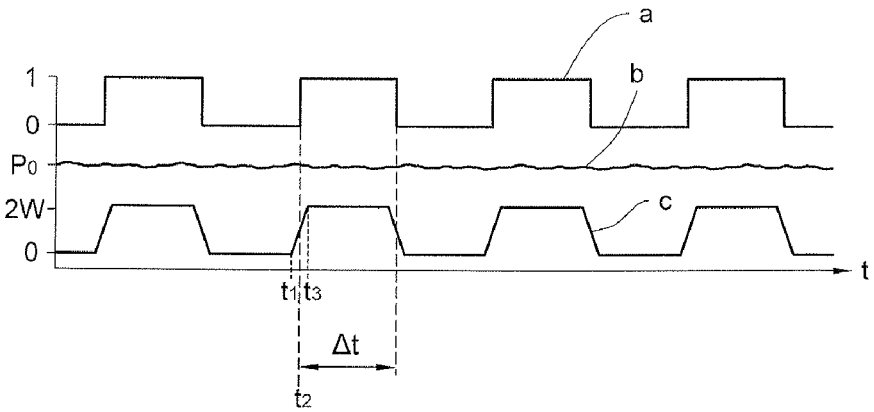

Further advantages of the invention emerge with reference to non-cited dependent claims and from the description below of the exemplary embodiments which are illustrated in the drawings, in which:

FIG. 1 shows a highly schematic exploded illustration of an apparatus according to the invention for the application of a liquid to pasty medium onto an application surface (not illustrated), FIG. 2 shows an enlarged schematic view of a volumetric delivery pump or a volumetric delivery pump unit of an apparatus according to FIG. 1, which is in the form of a gear pump and which has a driving gearwheel which protrudes out of the housing and can interact with a shaft gearwheel of a drive shaft (not illustrated in FIG. 2), FIG. 3*a* shows, in a highly schematic view, a sectional illustration through the assembled apparatus from FIG. 1, approximately according to the viewing arrows III in FIG. 1, when the application module is in an open state and the application valve is open, with the gear pump being driven, FIG. 3*b* shows the apparatus in a view according to FIG. 3*a* with the application valve in the closed state and the gear pump at a standstill, FIG. 4 shows a highly schematic illustration in the manner of a diagram of the temporal development of three characteristic variables of an apparatus of the prior art, and FIG. 5 shows, in a view according to FIG. 4, the temporal development of three characteristic variables of an apparatus according to the invention.

The apparatus according to the invention is denoted in the entirety thereof by 10 in the figures. For the sake of clarity, identical or comparable parts or elements, even if different exemplary embodiments are concerned, are denoted by the same reference numbers, sometimes with the addition of small letters or apostrophes.

The apparatus 10 illustrated in FIG. 1 is an apparatus for the intermittent application of a molten hotmelt adhesive to a two-dimensional substrate, in particular a non-woven capable of being in web form. In this connection, FIG. 1 shows an exploded illustration, in which the individual components of the apparatus 10 are illustrated partially disassembled.

According to FIG. 1, the apparatus 10 first of all has a fluid connection 11 for introducing a molten hotmelt adhesive or another medium into the apparatus 10 according to the invention. The fluid connection 11 here can be connected, for example via a delivery hose, to a reservoir (not illustrated) of a medium, wherein the reservoir can make the molten hotmelt adhesive available.

The reservoir may be, in particular, a hotmelt unit which first of all melts solid adhesive material and then passes said material on via a heated hose. For this purpose, the reservoir may also have a main delivery pump which ensures that the apparatus 10 according to the invention is always supplied with sufficiently molten adhesive.

In this connection, the fluid connection 11 is arranged on a filter block 12 of the apparatus 10, into which interchangeable filter elements 13*a* and 13*b* can be inserted. Said filter elements 13 can filter the fluid entering the rest of the apparatus 10, i.e. the liquid adhesive, in respect of impurities such that, as the fluid continues to pass through, deposits and clogging do not occur in the apparatus 10. The apparatus 10 fundamentally consists of an elongate driving block 14 and of an adapter block 15 which is mounted on the driving block 14. The filter block 12 here is fixed on an end side of the driving block 14 and adapter block 15.

As can be seen in FIG. 1, the central driving block 14 has, in the longitudinal direction I thereof, a central passage channel 16 through which the fluid or material which has entered the apparatus 10 through the fluid connection 11 can flow.

Furthermore, the passage channel 16 serves to receive a drive shaft 17 which has yet to be described in more detail further on.

In addition, on a rear side which cannot be seen in FIG. 1, the driving block 14 has connecting options for volumetric delivery pump units 18, wherein, in FIG. 1, eight such delivery pump units or volumetric delivery pumps 18 are already arranged on the driving block 14, and one volumetric delivery pump 18 is illustrated still in the unfitted state. The volumetric delivery pumps 18 are also described in more detail below.

On a front side which is concealed in FIG. 1, the adapter block 15 which has already been mentioned is mounted, substantially congruently, on the driving block 14. Said adapter block 15 serves for the mounting of application modules or application valves 19 and also compressed air modules 20 on the modular apparatus 10.

In the view according to FIG. 1, in each case eight application valves 19 and eight compressed air modules 20 are already fitted on the adapter block 15 and on the apparatus 10, respectively, while one application valve 19 and one compressed air module 20 are illustrated in a non-assembled state. In this case, the application valves 19 may be mounted on a side wall 52 of the adapter block 15 and the compressed air modules 20 may be mounted on an upper side 21 of the adapter block 15.

It should already be mentioned at this juncture, that one compressed air module 20 is assigned to each application valve 19 in such a manner that the corresponding application valve 19 can be switched pneumatically between an open and a closed state via the corresponding compressed air module 20. Similarly, each application valve 19 is assigned precisely one volumetric delivery pump 18 in the manner of a gear pump. For this purpose, sections (not visible in FIG. 1) of a connecting channel for conducting a measured-out fluid volume are provided in each case in the corresponding delivery pump 18, the driving block 14 and in the adapter block 15 and the corresponding application valve 19.

According to FIG. 1, the apparatus 10 furthermore comprises an air heater module 22 which can be fitted under the driving block 14 and the adapter block 15 and serves to heat spraying air conducted through the air heater module 22. The spraying air can be dispensed to the nozzle heads 23 of the application valves 19 by the air heater module 22 in order to serve as carriers for the fluid to be discharged. So that the adhesive which is to be dispensed is not already cooled during the discharging and spraying, the carrier air is pre-heated in the air heater 22.

The drive shaft 17 which is already mentioned and which can be introduced into the passage channel 16 of the driving block 14 is assigned a number of shaft gearwheels 24 (in particular corresponding to the number of delivery pumps 18 provided). Only one of said shaft gearwheels 24 can be seen in FIG. 1. However, it should be noted that the drive shaft 17 has one shaft gearwheel 24 per delivery pump 18.

In addition, in order to assemble the apparatus 10, a closing plate 25 is provided, the closing plate being able to be plugged on over the end section of the shaft 17 and having a central opening 26, through which the drive shaft 17 can interact with a driving motor 27. In the exemplary embodiment illustrated in the figures, said driving motor 27 is designed as a servomotor and can drive the drive shaft 17, for example, via a coupling 28 (not specified in more detail). The motor 27 and coupling 28 accordingly form parts of a drive 51.

The servomotor 27 is connected via a line 29 (merely indicated schematically) to a controller (likewise merely illustrated highly schematically) which is designed as a computer unit 30. The computer unit 30 is furthermore connected via a second line 31 to the application valves 19, namely indirectly via the compressed air modules 20. For example, a connection for the line 21 can be provided on the compressed air modules 20. The line 31 can pass on a control signal, which is output by the computer unit 30, to the compressed air modules 20 and the latter can thereby transmit controlling signals for switching the application valves 19. In FIG. 1, the line 31 and the corresponding connection thereof to the compressed air modules 20 is illustrated merely in principle and highly schematically. In practice, the line 31 may comprise a plurality of signal lines, one each for each compressed air module, and therefore, contrary to the illustration in FIG. 1, each compressed air module 20 can have a dedicated connection for connecting to the controller.

Starting from the exploded illustration of FIG. 1, the apparatus 10 can be assembled and fitted in such a manner that each volumetric delivery pump 18 is assigned precisely one shaft gearwheel 24 of the drive shaft 17.

In the fitted state of the apparatus 10, said shaft gearwheel 24 can engage in a driving gearwheel 32 of the delivery pump unit 18, which is illustrated in enlarged form in FIG. 2, in order to drive the volumetric delivery pump 18.

In this connection, FIG. 2 first of all shows two bolt-like installation aids 34*a* and 34*b*, for example screws, which are fixed to the housing 33 of the volumetric delivery pump 18.

A medium passing through the passage channel 16 (not illustrated in FIG. 2) of the driving block 14 can enter the housing 33 of the otherwise encapsulated delivery pump unit 18 at entry points 35*a* and 35*b* above and below the driving gearwheel 32. For this purpose, the housing 33 has an entry slot 36, through which the driving gearwheel 32 is partially inserted.

Finally, FIG. 2 also shows a fluid outlet 37 which is arranged in the housing 33 and through which the fluid volume, which is then metered, can leave the delivery pump 18 again in order to enter a corresponding channel extension of the driving block 14 and subsequently of the adapter block 15.

In addition to the driving gearwheel 32, the volumetric delivery pump 18 also has two further gearwheels which cannot be seen in FIG. 2 but which will be described below with reference to FIGS. 3*a* and 3*b*, together with the operative principle of the apparatus 10 according to the invention.

It can first of all be seen from FIG. 3*a* that two further gearwheels, namely the metering gearwheels 38*a* and 38*b*, are also arranged within the housing 33 of the volumetric delivery pump 18, said gearwheels being connected to the driving gearwheel 32 in a series connection. The gearwheels 32, 38*a* and 38*b* are respectively arranged here in a plane on rotating spindles 39*a*, 39*b* and 39*c* not penetrating the housing 33. The gearwheels which are illustrated in FIG. 3*a* intermesh in such a manner that driving of the drive shaft 17 by the driving motor 27 (not illustrated in FIG. 3*a*) leads to rotation of the shaft gearwheel 24 counterclockwise with respect to FIG. 3*a*. The toothing of the shaft gearwheel 24 engages here in the toothing of the driving gearwheel 32 in such a manner that said driving gearwheel rotates in the clockwise direction with respect to FIG. 3*a*. Owing to the toothing of the driving gearwheel 32 and metering gearwheel 38*a*, said metering gearwheel 38*a* then rotates counterclockwise with respect to FIG. 3*a* and, owing to the toothing thereof, ensures rotation of the second metering gearwheel 38*b* in the clockwise direction with respect to FIG. 3.

These rotations of the gearwheels 24, 32, 38*a* and 38*b* lead to the viscous medium 40 which flows around the gearwheels and which is illustrated by hatching in FIGS. 3*a* and 3*b* being carried along (and, in addition, also lead to metering thereof).

In respect of the conducting path of the medium 40, reference should be made at this juncture to FIG. 1, with regard to which it has already been explained that the medium 40 can enter the apparatus 10 at a fluid connection 11 and is then conducted into a passage channel 16 of the driving block 14. In the driving block 14, said medium flows, according to FIG. 3*a*, around the drive shaft 17 together with the shaft gearwheel 24 arranged thereon.

The medium or fluid 40 is carried along within the volumetric delivery pump 18 by the gearwheels 32, 38*a* and 38*b* and conducted towards an inlet 41 of a conducting channel 42. During the conduction from the driving gearwheel 32 toward the inlet 41, the medium 40 is metered in respect of the volume thereof in such a manner that a certain number of revolutions of the metering gearwheels 38*a* and 38*b* lead to a desired metering volume of the medium 40.

The metered volume 40 can then be introduced into the conducting channel 42 through the inlet 41 (not illustrated more precisely in FIG. 3*a*). The inlet 41 to the conducting channel 42 leads out of the plane of the figure with respect to FIG. 3*a*. Accordingly, a first subsection 43 of the conducting channel 42 is merely indicated by dashed lines in FIG. 3*a*, since said subsection does not lie in the sectional plane of FIG. 3*a* (but rather below the sectional plane of FIG. 3*a*).

By means of the offset arrangement of the subsection 43 of the conducting channel 42, the metered and delivered medium 40 can leave the housing 33 of the delivery pump 18 via the fluid outlet 37 and enter a continuation of the conducting channel 42 in the driving block 14. The first subsection 43 then has a beveled region in the driving block 14 such that the conducting channel 42 together with medium delivered therein enters the sectional plane of FIG. 3*a* again.

Finally, at an outlet 44, the delivered medium 40 can leave the driving block 14 and be introduced into the adapter block 15, from which said medium enters the application valve 19. The conducting channel 42 is composed here of a plurality of subsections assigned to the different modules 18, 19 and blocks 14, 15. Within the application valve 19, the medium 40 can then pass into a nozzle chamber 45 and from there (since the valve 19 according to FIG. 3*a* is in the open state thereof) on into the region of an outlet opening 46.

With regard to the application valve 19 illustrated in FIG. 3*a*, it should also be noted that said application valve forms what is referred to as a recirculating valve. In this connection, the valve head 47 is illustrated in an open, lowered position, in which it allows the medium 40 to pass. In particular, the lower region of the valve head 47 can have slots or channels (not illustrated) which, in the illustrated position of the valve head 47, allows the medium 40 to pass out of the nozzle chamber 45.

As soon as the medium 40 reaches the outlet opening 46, heated carrier air is fed to the medium 40 via a line 48. This can ensure a spraying effect (which is indicated in FIG. 3*a* by a snake-like outlet shape of the medium 40).

The carrier air is supplied here via an air heater module 22 having a heating element 49. The heating of the carrier air ensures that the medium 40 does not cool and solidify upon contact with the carrier air 48 but rather, on the contrary, can pass in fluid form onto a substrate which is not illustrated in FIG. 3*a* (and which would be arranged with respect to FIG. 3*a* below the illustrated apparatus 10).

With regard to FIG. 3*a*, it should finally be noted that, in the exemplary embodiment illustrated, the application valve 19 is activated pneumatically and can thereby be switched between the closed and open state thereof. For this purpose, the adapter block 15 provides two compressed air entrances 50*a* and 50*b*, the compressed air channel 50*b* (indicated by the arrow) being able to be charged in order to transfer the application valve 19 into the open state. For this purpose, a compressed air module 20 (not illustrated in FIGS. 3*a* and 3*b*) can be arranged above the adapter block 15 and can be activated in particular by the computer unit 30, which is illustrated in FIG. 1.

Since the present apparatus 10 is an apparatus for the intermittent application of a medium 40, after a metered portion of adhesive 40 has been discharged the application valve 19 is transferred from the open state thereof, which is illustrated in FIG. 3*a*, into the closed state thereof, which is illustrated in FIG. 3*b*. For this purpose, the compressed air module 20 (not illustrated in FIGS. 3*a* and 3*b*) can be activated by the computer unit 30 (likewise only illustrated in FIG. 1) in such a manner that the compressed air channel 50*a* (illustrated in FIG. 3*b*) in the adapter block 15 (and no longer the compressed air channel 50*b*) is charged with compressed air. According to FIG. 3*b*, this leads to a pneumatically triggered raising of the valve head 47 onto a valve seat 53 in such a manner that the medium 40 arranged in the conducting channel 42 is now prevented from passing into the nozzle chamber 45 (and therefore also into the outlet opening 46). In this case, the spraying air supplied via the line 48 can either also be switched off via the computer unit 30 or can continue to emerge, with the application pattern on the surface being commissioned not being changed.

Since the walls of the conducting channel 42 illustrated in FIG. 3*b* are of rigid and inflexible design, and since, according to FIG. 3*b*, the conducting channel 42 is also not assigned any return mechanism, closing of the application valve 19 with the delivery pump 18 continuing to operate would lead to an excessive build up of pressure within the conducting channel 42. Said build up of pressure could lead to activation of a pressure control valve (not illustrated). At any rate, during subsequent opening of the application valve, the application surface being commissioned would be commissioned inhomogeneously with medium.

However, a solution to the problem can be gathered from FIG. 3*b* to the effect that none of the gearwheels 24, 32, 38*a* or 38*b* illustrated is provided with an arrow arranged on the gearwheel. Within the context of the present exemplary embodiment, this is intended to signify that the gearwheels, and in particular the shaft gearwheel 24 and the drive shaft 17, do not rotate at all when the application valve 19 is closed. The result therefrom is that the gearwheels 32, 38*a* and 38*b* do not deliver any further medium 40, and therefore no further medium enters the inlet 41 and the conducting chamber 42 either.

The pressure of the medium or of the fluid 40 therefore does not increase (or merely insubstantially increases) in the conducting channel 42. As soon as, subsequently, an opening operation of the application valve 19 takes place, the medium 40, without being under particularly great pressure, can be discharged in the customary manner and delivered on, with a homogeneous application pattern and a homogenous layer thickness.

The fact that, in a state according to FIG. 3*b*, the drive shaft 17 is not driven is ensured by the servomotor 27 which is illustrated in FIG. 1 and receives the signal from the computer unit 30 to pause the drive shaft 17. Said command is issued by the computer unit 30 synchronously to the command to the compressed air module 20 to close the application valve 19 (or to charge the compressed air channel 50*a* according to FIG. 3*b*).

The mutually coordinated activation of the drive 51 (comprising the motor 27 and the coupling 28) and the application valve 19 will now be clarified with reference to FIGS. 4 and 5:

FIGS. 4 and 5 illustrate three characteristic curves, in each case one above another, of an apparatus of the prior art (FIG. 4) and of an apparatus according to the invention (FIG. 5). Said characteristic curves are time-dependent characteristic curves, i.e. the development of characteristic values over the time t. The three characteristic curves a, b, c and a', b', c' are arranged here one above another in the same system of coordinates merely for the sake of clarity, but this, however, is not intended to make any statement about the absolute values thereof but rather merely to permit a relative comparison of the temporal developments.

The characteristic curve a or a' relates here to the switching of the application valve 19 or of the nozzle valve between the switched-on state (at a relative value of 1) and a switched-off state (at an absolute value of 0). The characteristics curves a according to FIG. 5 and a' according to FIG. 4 correspond identically to each other. A switching cycle of the valve, i.e. the time interval in which the application valve is switched to and fro once completely between the open state thereof and the closed state thereof corresponds in the present case to a period of time of $2\times\Delta t$. $\Delta t$ here can correspond, for example, to a value of 20 to 50 ms, wherein a cycle duration is therefore between 40 to 100 milliseconds.

If the characteristic curves a and a' in FIGS. 4 and 5 reach the value thereof which is denoted by 1, the application valve is completely open and, at 0, is completely closed.

The fact that, in the illustrated exemplary embodiment according to FIG. 5, the cycle time has a value of approximately 2 $\Delta t$ means that the application valve 19, at any rate in the present exemplary embodiment, is in the closed state thereof for approximately half of the time (or of the cycle duration) and in the open state thereof for the other half of the time. The ratio of the application valve 19 in terms of opening and closing times is therefore approximately 0.5. The present invention is particularly advantageously used with such a ratio, since the described problem arises particularly emphatically in such cases.

By contrast, at a greater value, at which the opening time of the valve dominates, the closing time is so short that no problematic pressure can build up at all. On the other hand, in the case in which the closing time dominates the ratio, the opening time is customarily of such a short duration that the pressure remains consistently high during the opening time.

Accordingly, the present invention is particularly advantageously used in particular at a ratio of opening to closing time of between 0.2 and 0.8 (in particular at a value of between 0.4 and 0.6).

The characteristic curves, which are identified by b and b', in FIGS. 4 and 5 relate to the built-up fluid pressure in the channel 42 directly upstream of the application valve 19. A corresponding measurement can take place, for example, directly at the inlet of the application valve 19. FIG. 4 shows here, with reference to the characteristic curve b', the problem of the prior art, according to which the fluid pressure always dissipates when the valve 19 is opened and continuously builds up again when the application valve 19 is closed. In this case, a maximum value $P_1$ of the measured pressure can be, for example, approximately between 40 and 50 bar, and the value $p_0$ can be approximately 20 bar or very much less. FIG. 5 shows, by contrast, that the pressure within the fluid-conducting channel 42 (in the region of the application valve 19) is at a virtually constant level.

The characteristic curves b in FIG. 5 therefore indicates that the problem on which the invention is based of inhomogeneous application can be solved by a uniform fluid pressure of the apparatus 10 according to the invention.

Finally, the characteristic curves c and c' in FIGS. 4 and 5 indicate the switching of the drive 51 of the volumetric metering pump 18 and therefore, in particular, the switching of the servomotor 27 used in the exemplary embodiment of FIGS. 1 to 3. According to FIG. 4, in the case of the apparatus of the prior art, the motor runs at a constant power or a constant number of revolutions per minute, for example 10 revolutions per minute.

In the case of the apparatus 10 according to the invention according to FIG. 5, it can be gathered from the characteristic curve c that the servomotor 27 is switched between an off state (0 revolutions per minute) and a driven state synchronously to the switching of the application valve 19 according to the characteristic curve a. In order to achieve the same delivery rate as in the apparatus of the prior art, the servomotor 27 can preferably be adjusted, when the application valve 19 is open, to a value of 2 W, i.e., for example, 20 revolutions per minute. In other words, at a ratio of the opening and closing time of approximately 0.5, the servomotor 27 can preferably drive the metering pump 18 at twice the speed achieved in the case of an apparatus of the prior art (although the latter is driven continuously).

Finally, it is noticeable in FIG. 5 that the motor 27 is activated cyclically in each case slightly before the application valve 19, which can be identified by the fact that the time $t_1$, at which a signal is output to the motor 27, lies temporally before the time $t_2$, at which a signal is output to the application valve 19. Such an activation levels out the relatively great inertia of the drive 51 in comparison to the relatively small inertia of the application valve switching, which is itself produced by the mechanical components of the delivery pump 18 and the mechanical components of the drive 51.

According to the characteristic curve a, the switching state of the application valve has in case idealized, perpendicular flanks during the initiation of an opening and closing operation, namely, for example, at the time $t_2$. During calibration of the controller, the time $t_2$ is preferably selected in such a manner that said time lies temporally precisely between the time $t_1$ and the time $t_3$, wherein the time $t_3$ characterizes the time at which the servomotor 27 reaches the desired maximum power thereof, in particular 2 W. Although said example is explicitly related to an opening operation of the valve 19, it is analogously also transferable to a closing operation.

The invention claimed is:

1. An apparatus for the intermittent application of a liquid to pasty medium onto an application surface, comprising:

a driving block, an adapter block mounted on the driving block, an application valve mounted on the adapter block, the application valve switchable between an open and a closed state for selectively dispensing the medium onto the application surface, a volumetric delivery pump connected to the driving block, the volumetric delivery pump configured for metering a volume of the medium to be passed on to the application valve, wherein the volumetric delivery pump is a gear pump, a conducting channel formed in the driving block and the adapter block and extending between the volumetric delivery pump and the application valve configured for passage of the medium from the volumetric delivery pump to the application valve, and a drive for operating the volumetric delivery pump, wherein the apparatus has an electronic controller which, in each case cyclically, switches the drive between an off state and a driven state and switches the application valve between the open and closed state in dependence on each other such that for dispensing the medium, the electronic controller switches the drive to the driven state and the application valve to the open state, and for stopping dispensing of the medium, the electronic controller switches the drive to the off state and the application valve to the closed state, wherein the electronic controller switches the drive to the driven state before switching the application valve to the open state, and wherein the electronic controller switches the drive to the off state before switching the application valve to the closed state.

2. The apparatus as claimed in claim 1, wherein the medium is a molten adhesive or molten adhesive agent and the apparatus further comprises heating means for heating the molten adhesive or adhesive agent conducted in the apparatus, the apparatus being assigned a hotmelt unit for melting the adhesive or adhesive agent.

3. The apparatus as claimed in claim 1, wherein the drive has a motor, the motor being designed as a servomotor or stepping motor, or an eddy current coupling or solenoid coupling being provided between the motor and the volumetric delivery pump.

4. The apparatus as claimed in claim 1, wherein the gear pump which comprises three gearwheels, of which one is designed as a driving gearwheel which interacts with a separate shaft gearwheel assigned to a motor-side drive shaft.

5. The apparatus as claimed in claim 1, wherein the application surface is provided by a two-dimensional substrate, the substrate being a moving, web-shaped substrate, and the apparatus comprises a delivery device for guiding the substrate relative to an outlet nozzle assigned to the application valve.

6. The apparatus as claimed in claim 1, wherein the conducting channel is of a rigid, and sealed, design.

7. The apparatus as claimed in claim 1, wherein the apparatus is designed as a modular system, with a multiplicity of linearly arranged, application modules, each application module having precisely one application valve and being connected to one volumetric delivery pump unit each, and the linearly arranged, volumetric delivery pump units being drivable by a common drive shaft.

8. The apparatus as claimed in claim 1, wherein the medium is a molten adhesive or molten adhesive agent and the apparatus further comprises heating means for heating the molten adhesive or adhesive agent conducted in the apparatus.

9. The apparatus as claimed in claim 1, wherein the apparatus is designed as a modular system, with a multiplicity of linearly arranged, application modules, each application module having precisely one application valve and being connected to one volumetric delivery pump unit.

* * * * *